US008098026B2

(12) United States Patent
Kinderman

(10) Patent No.: US 8,098,026 B2
(45) Date of Patent: Jan. 17, 2012

(54) LIGHTING CONTROL CIRCUIT

(75) Inventor: Israel Richard Kinderman, Philadelphia, PA (US)

(73) Assignee: Brite Star Manufacturing Co., Inc., Philadelphia, PA (US)

( * ) Notice: Subject to any disclaimer, the term of this patent is extended or adjusted under 35 U.S.C. 154(b) by 347 days.

(21) Appl. No.: 12/252,105

(22) Filed: Oct. 15, 2008

(65) Prior Publication Data

US 2010/0060188 A1 Mar. 11, 2010

Related U.S. Application Data

(60) Provisional application No. 60/980,001, filed on Oct. 15, 2007.

(51) Int. Cl.
*H05B 37/02* (2006.01)

(52) U.S. Cl. ..... 315/297; 315/312

(58) Field of Classification Search ..... 315/291, 315/294–297, 312
See application file for complete search history.

(56) References Cited

U.S. PATENT DOCUMENTS

| | | | | |
|---|---|---|---|---|
| 6,213,623 | B1 * | 4/2001 | Campman | 362/202 |
| 6,980,181 | B2 * | 12/2005 | Sudo | 345/82 |
| 7,253,566 | B2 | 8/2007 | Lys et al. | |
| 7,781,979 | B2 * | 8/2010 | Lys | 315/185 S |
| 2010/0123417 | A1 * | 5/2010 | Sharrah et al. | 315/362 |

OTHER PUBLICATIONS

Brite Star Manufacturing catalog, pp. 28-29, 2008.

* cited by examiner

*Primary Examiner* — Don Le
(74) *Attorney, Agent, or Firm* — Connolly Bove Lodge & Hutz LLP

(57) ABSTRACT

The present invention is directed to an LED light system that comprises a control circuit that operates on a pair of 1.5 volt batteries but which generates an operational voltage in excess of 3.0 volts. The lighting system includes a boost circuit that raises the operational voltage of the system to 5.0 volts, and an output circuit connected to a plurality of LEDs that controls their function.

11 Claims, 8 Drawing Sheets

LIGHTING CONTROL CIRCUIT

This application claims the benefit of U.S. Provisional Application No. 60/980,001 filed on Oct. 15, 2007.

FIELD OF THE INVENTION

The invention described herein relates to lighting systems, and more particularly to apparatus for supplying power and controlling various light sources that may be coupled together.

BACKGROUND OF THE INVENTION

Light emitting diodes (LEDs) are semiconductor-based light sources often employed in low-power instrumentation and appliance applications as indicators. LEDs are available in a variety of colors (e.g. red, green, blue) based on the types of materials used in their fabrication. LEDs are becoming increasingly popular in decorative applications such as Christmas tree lights and outdoor decorative lighting. In these applications, LEDs are favored devices due to their ability to emit a wide range of dazzling colors and produce light of high intensity. LED lighting systems are commonly configured to run on AC or DC (battery) power. Due to their high efficiency and low power requirements, LED Christmas lights, for example, are commonly configured to operate utilizing a pair of 1.5 volt batteries as a power supply. When the lights have a flashing capability however, up to 4.5 volts is required to power them. Accordingly, Christmas lights of this type require at least three 1.5 volt batteries to operate.

Housing three batteries requires a larger battery pack which occupies more space than a two-battery assembly thus making the light assembly less compact. It would be advantageous, therefore, to have a decorative LED light system that can provide an operational voltage in excess of 3.0 volts, which requires only a pair of 1.5 volt batteries to operate.

SUMMARY OF THE INVENTION

The present invention is directed to an LED light system that comprises a control circuit that operates on a pair of 1.5 volt batteries but which generates an operational voltage in excess of 3.0 volts.

Aspects of the present invention are generally directed to an LED lighting system. In one aspect of a preferred embodiment of the invention, the lighting control system comprises a boost circuit that includes a first integrated circuit operatively connected to an output circuit, which includes a second integrated circuit, and a plurality of LEDs. The boost circuit is powered by a pair of 1.5 volt batteries which collectively supply an input voltage of 3.0 volts to the boost circuit. In the preferred embodiment, the boost circuit raises the input voltage to 5.0 volts. The higher voltage is provided to an output circuit which includes a second integrated circuit which distributes the power to the plurality of LEDs. The second integrated circuit includes a pair of triodes that independently power two groups of LEDs connected to the second integrated circuit.

In another aspect of the invention, a second embodiment comprises a boost circuit that includes a first integrated circuit operatively connected to an output circuit which includes a second integrated circuit, and a plurality of LEDs. The boost circuit is powered by a pair of 1.5 volt batteries which collectively supply an input voltage of 3.0 volts to the boost circuit. In the second embodiment the boost circuit raises the input voltage to 5 volts. The higher voltage is provided to the second integrated circuit which distributes the power to a single group of LEDs.

In another aspect of the invention, a third embodiment of the invention comprises a boost circuit that includes a first integrated circuit operatively connected to a second integrated circuit and a plurality of LEDs. The boost circuit is powered by a pair of 1.5 volt batteries which collectively supply an input voltage of 3.0 volts to the boost circuit. In the third embodiment, the boost circuit raises the input voltage to 5 volts. The higher voltage is provided to the second integrated circuit which distributes the power to a plurality of LEDs. The second integrated circuit includes a pair of triodes that independently power two groups of LEDs connected to the second integrated circuit. The third embodiment further comprises a timer operatively connected to at least one of the first and second integrated circuits to permit automatic initiation of the operation of the lighting system at a predetermined time and termination of the operation after a predetermined interval, thereby conserving battery consumption and permitting the recovery of battery charge during operational cycles.

In a fourth embodiment, the invention comprises a boost circuit that includes a first integrated circuit operatively connected to a second integrated circuit and a plurality LEDs. The boost circuit is powered by a pair of 1.5 volt batteries which collectively supply an input voltage of 3.0 volts to the boost circuit. In the second embodiment the boost circuit raises the input voltage to 5 volts. The higher voltage is provided to the second integrated circuit which distributes the power to a single group of LEDs. The fourth embodiment further comprises a timer operatively connected to at least one of the first and second integrated circuits to permit automatic initiation of the operation of the lighting system at a predetermined time and termination of the operation after a predetermined interval, thereby conserving battery consumption and permitting the recovery of battery charge during operational cycles.

The pair of batteries used in the above described embodiments of the invention can be housed in a battery housing that is adapted for the serial connection of a plurality of battery housings to permit the synchronized operation of a plurality of LEDs provided in individually powered lighting strings. The battery housing of the present invention can also be connected to an LED light module to permit the illumination of objects adjacent to the lighting system being powered by the battery housing to which the LED lighting module is connected.

DETAILED DESCRIPTION OF THE PREFERRED EMBODIMENTS

Figure 1:
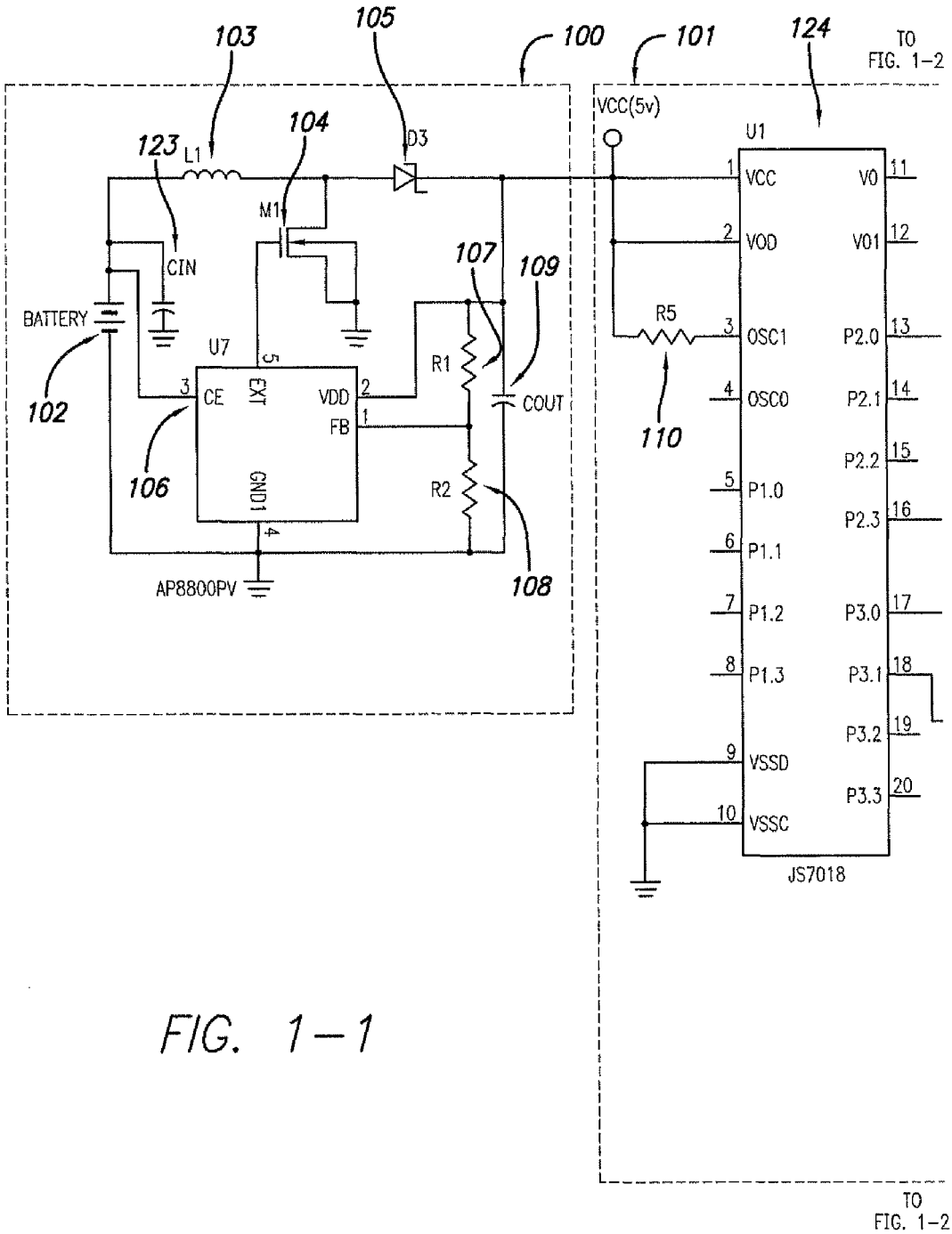
FIG. 1 is a circuit diagram of a preferred embodiment in accordance with the present invention.

An apparatus in accordance with the present invention may be generally understood from FIG. 1. As is depicted therein, a lighting circuit in accordance with the present invention comprises a boost circuit 100 which includes a pair of 1.5 volt batteries connected in series 102 that supply power to the lighting circuit. As shown, the positive pole of batteries 102 is connected to both an input capacitor 123 and an integrated circuit 106. In this arrangement, the negative pole of the input capacitor is connected to ground. An inductor 103 is connected between the positive pole of batteries 102 and the drain of N-channel MOS tube 104. MOS tube 104 in turn is connected to ground and pin 5 of integrated circuit 106 respectively. Pin 1 of integrated circuit 106 is connected to resistor 108 as shown, while the poles of resistor 107 are connected to pins 1 and 2 of integrated circuit 106 as shown. The grid of MOS tube 104 is connected to the positive pole of zener diode 105. The negative pole of zener diode 105 is connected to pin 2 of integrated circuit 106. The boost circuit 100 also includes an output capacitor 109 with its negative pole connected to ground.

The lighting circuit further comprises an output circuit 101 that includes an integrated circuit 124 as shown. The positive pole of output capacitor 109 of boost circuit 100 is connected to pins 1 and 2 of integrated circuit 124 as shown. Pins 9 and 10 of integrated circuit 124 are connected to ground in this embodiment. Resistor 110 is connected between pins 2 and 3 of integrated circuit 124 while pin 16 of integrated circuit 124 is connected to the collector of triode 111 as shown. The emitter of triode 111 is connected to pin 1 of integrated circuit 124, while resistor 112 is connected between the emitter and base of triode 111. Resistor 113 is connected between the base of triode 111 and ground. Reset button 125 is located at pin 13 of integrated circuit 124.

In the preferred embodiment shown in FIG. 1, pins 17 and 18 correspond to the output of integrated circuit 124. The output of pins 17 and 18 are connected to resistors 116 and 114 respectively and respectively connected to triode 117 and 115. Capacitor 126 is located between triodes 115 and 117. In this circuit, the collectors of triodes 117 and 115 are connected to resistors 118 and 119 respectively and also connected to the bases of triodes 120 and 121 respectively. The collector of triode 120 is connected to the collector of triode 115 and the collector of triode 119 is connected to the collector of triode 117. Between the collectors of triodes 115 and 117 are connected two groups of LED lighting load 122 consisting of a plurality of LEDs.

In this circuit arrangement, the supplied battery voltage of 3.0 volts is boosted by the boost circuit 100 to 5.0 volts. The boosted voltage is supplied to integrated circuit 124 where it is supplied to two groupings of LED lighting load 122. The lighting function of the LED lighting load 122 is controlled by integrated circuit 124 to perform a plurality of functions such as controlling LED color, flashing and the like.

Figures 1, 2:
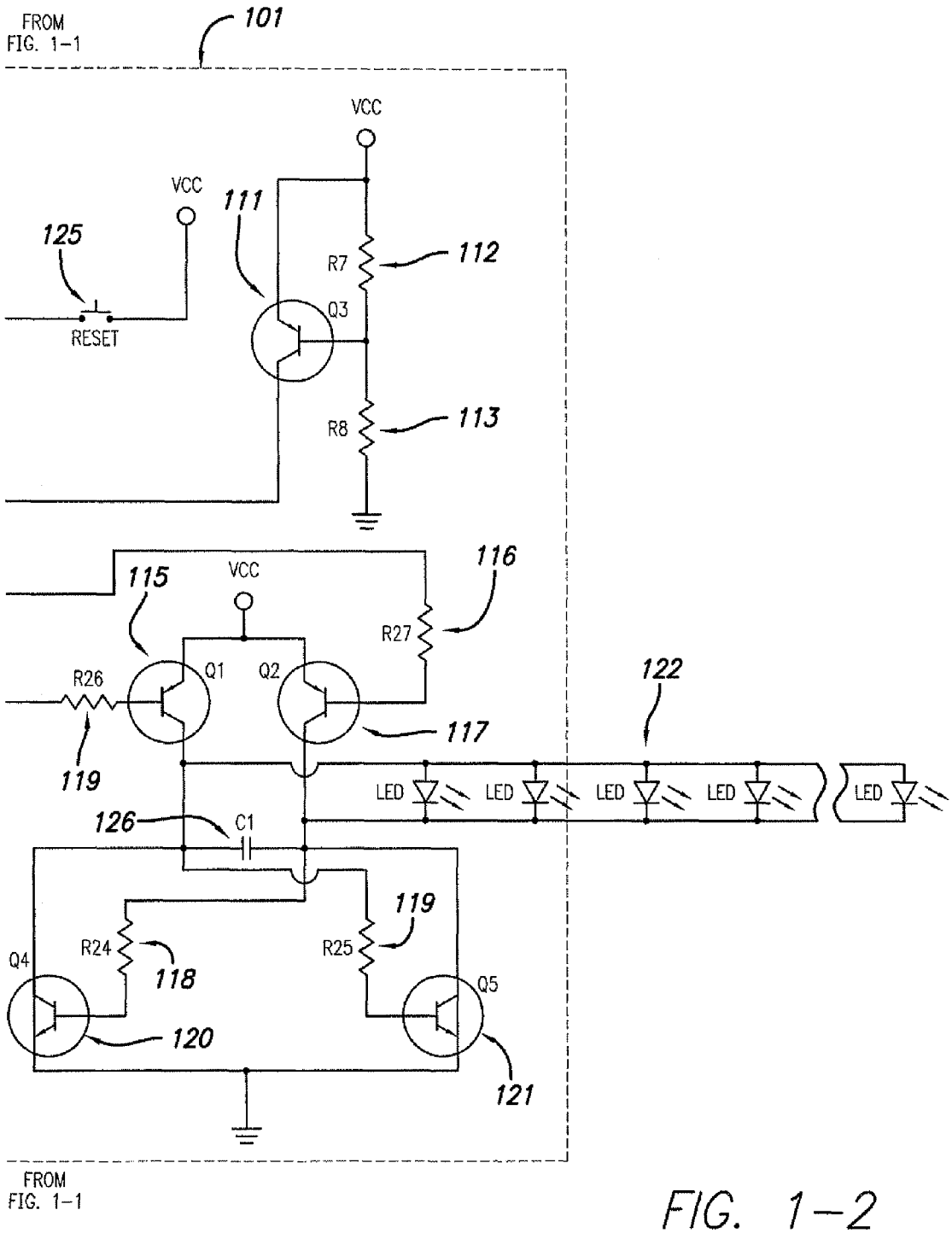
FIG. 2 is a circuit diagram of a second embodiment in accordance with the present invention.
Figures 1, 2:
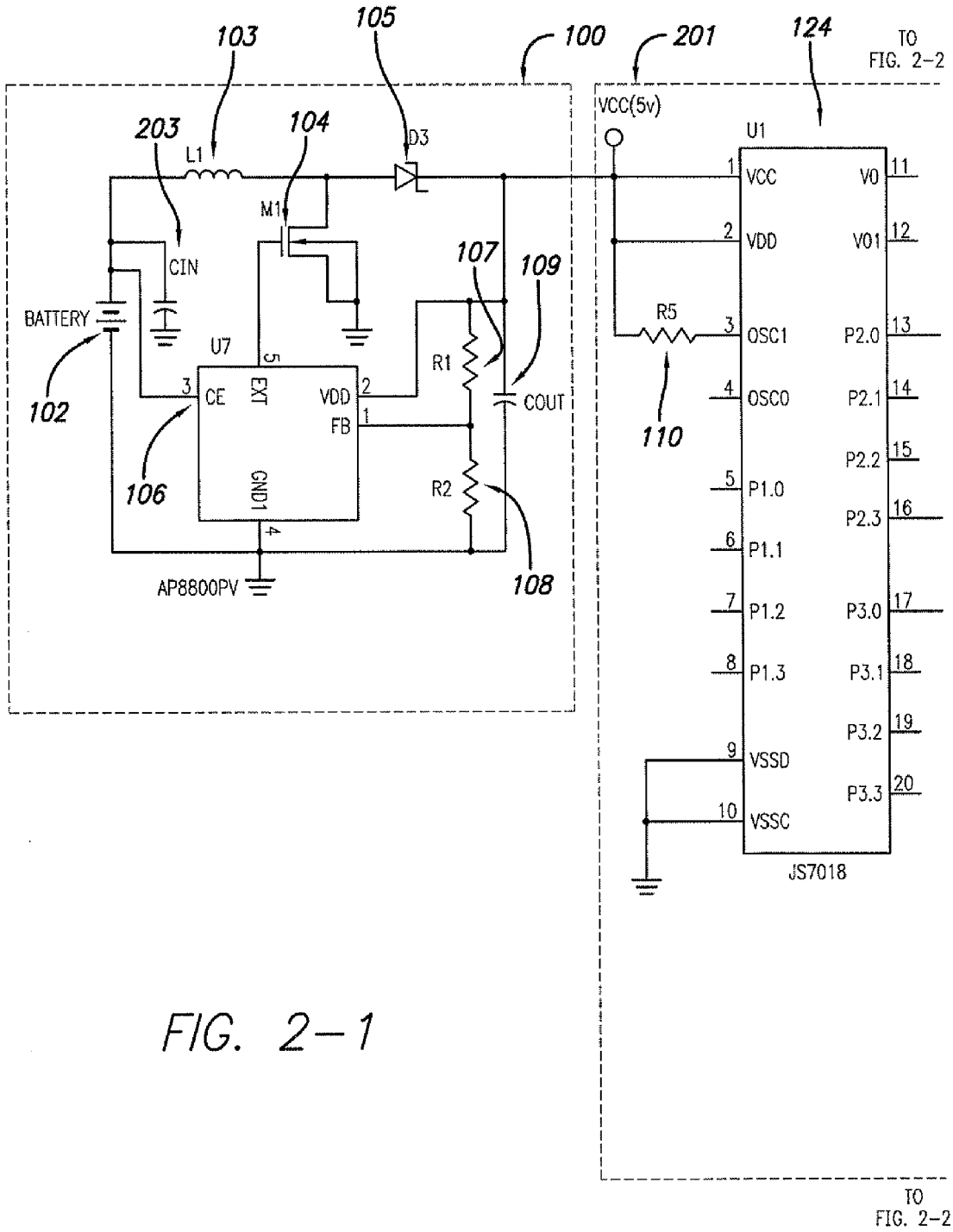
Figure 2:
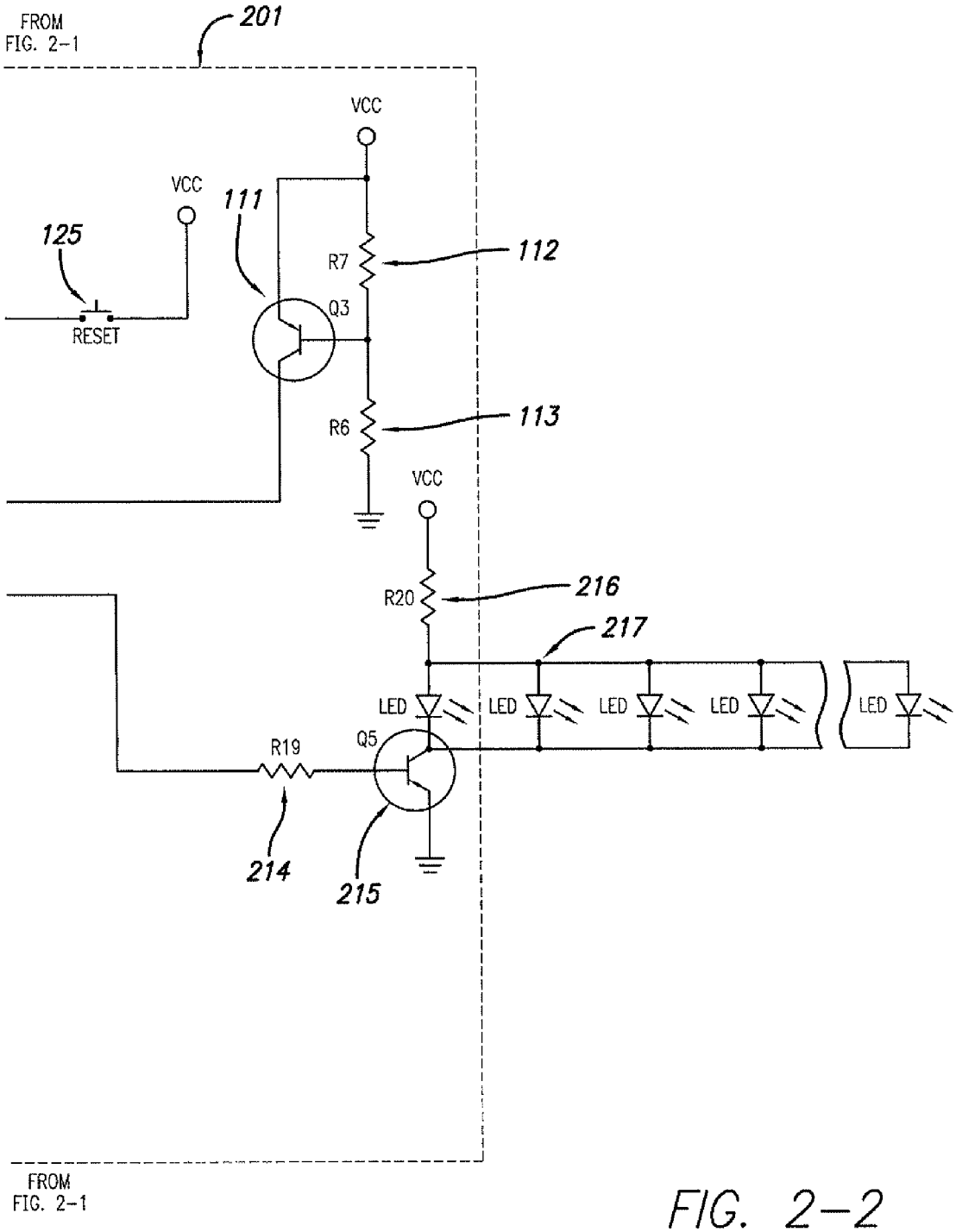

Referring now to FIG. 2, depicted therein is a circuit in accordance with a second embodiment of the invention. In the second embodiment, a lighting circuit in accordance with the present invention comprises a boost circuit 100 which includes a pair of 1.5 volt batteries connected in series 102 that supply power to the lighting circuit. As shown, the positive pole of batteries 102 is connected to both an input capacitor 123 and an integrated circuit 106. In this arrangement, the negative pole of the input capacitor 123 is connected to ground. An inductor 103 is connected between the positive pole of batteries 102 and the drain of N-channel MOS tube 104. MOS tube 104 in turn is connected to ground and pin 5 of integrated circuit 106 respectively. Pin 1 of integrated circuit 106 is connected to resistor 108 as shown, while poles of resistor 107 are connected to pins 1 and 2 of integrated circuit 106 as shown. The grid of MOS tube 104 is connected to the positive pole of zener diode 105. The negative pole of zener diode 105 is connected to pin 2 of integrated circuit 106. The boost circuit also includes an output capacitor 109 with its negative pole connected to ground.

The lighting circuit further comprises an output circuit 201 that includes an integrated circuit 124 as shown. The positive pole of output capacitor 109 of boost circuit 100 is connected to pins 1 and 2 of integrated circuit 124 as shown. Pins 9 and 10 of integrated circuit 124 are connected to ground in this embodiment. In this embodiment, pin 17 of integrated circuit 124 is the output pin which supplies current through resistor 214 and connects to the base of triode 215. In this embodiment, the emitter of triode 215 is connected to ground and resistor 214 is connected to the negative pole of zener diode 105 (5.0 volts at this point). Between resistor 216 and triode 215, an LED light set load 217 consisting of a plurality of LEDs is connected. The lighting function of the LEDs is controlled by integrated circuit 124 to permit flashing etc. of the LEDs.

Figure 3:
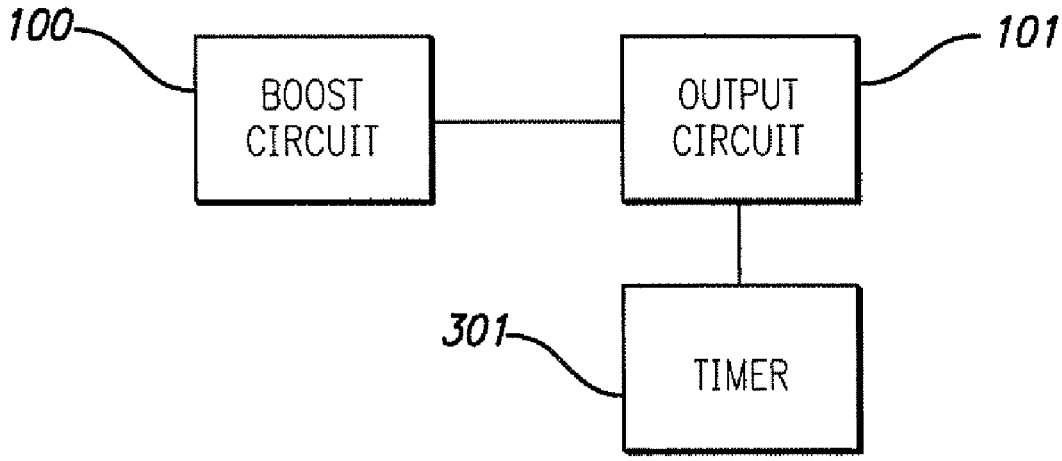
FIG. 3 is a high level block diagram depicting a third embodiment of the invention.

A third embodiment of the invention comprises a timer integrated into the embodiment shown in FIG. 1. FIG. 3 is a high-level block diagram that depicts a lighting system in accordance with the third embodiment. As is depicted therein, the third embodiment comprises a boost circuit 100 in accordance with the first embodiment of the invention described above. The boost circuit is operatively connected to an out put circuit 101 in accordance with the first embodiment of the invention described above. In the third embodiment, the lighting system further comprises a timer 301 operatively connected to the output circuit 101. This arrangement permits automatic initiation of the operation of the lighting system at a predetermined time and termination of the operation after a predetermined interval. The timer can be implemented as an integrated circuit or by other conventional means to permit automatic initiation of the operation of the lighting system at a predetermined time and termination of the operation after a predetermined interval, thereby conserving battery consumption and permitting the recovery of battery charge during operational cycles.

Figure 4:
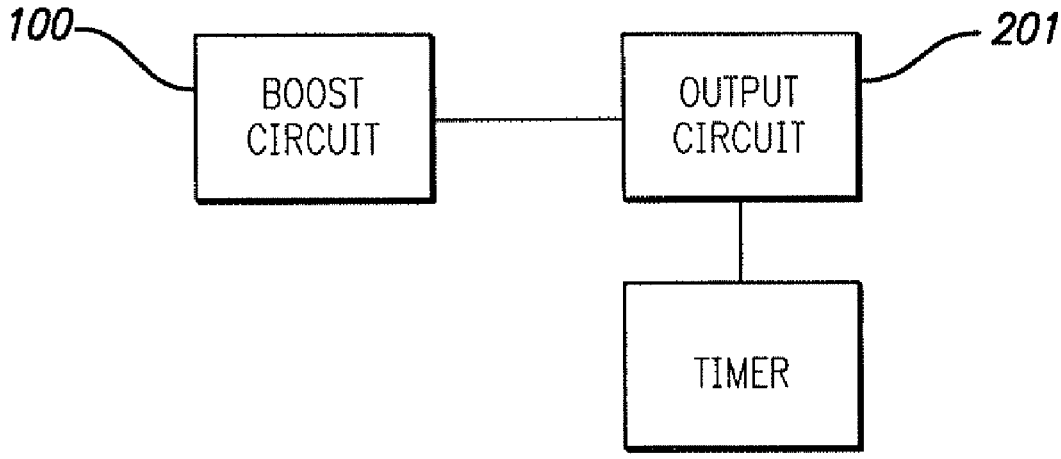
FIG. 4 is a high level block diagram depicting a fourth embodiment of the invention.

A fourth embodiment of the invention comprises a timer integrated into the embodiment shown in FIG. 2. FIG. 4 is a high-level block diagram that depicts a lighting system in accordance with the fourth embodiment. As is depicted therein, the fourth embodiment comprises a boost circuit 100 in accordance with the second embodiment of the invention described above. The boost circuit 100 is operatively connected to an output circuit 201 in accordance with the second embodiment of the invention described above. In the fourth embodiment, the lighting system further comprises a timer 301 operatively connected to the output circuit 201. This arrangement permits automatic initiation of the operation of the lighting system at a predetermined time and termination of the operation after a predetermined interval. The timer can be implemented as an integrated circuit or by other conventional means to permit automatic initiation of the operation of the lighting system at a predetermined time and termination of the operation after a predetermined interval, thereby conserving battery consumption and permitting the recovery of battery charge during operational cycles.

Figure 5:
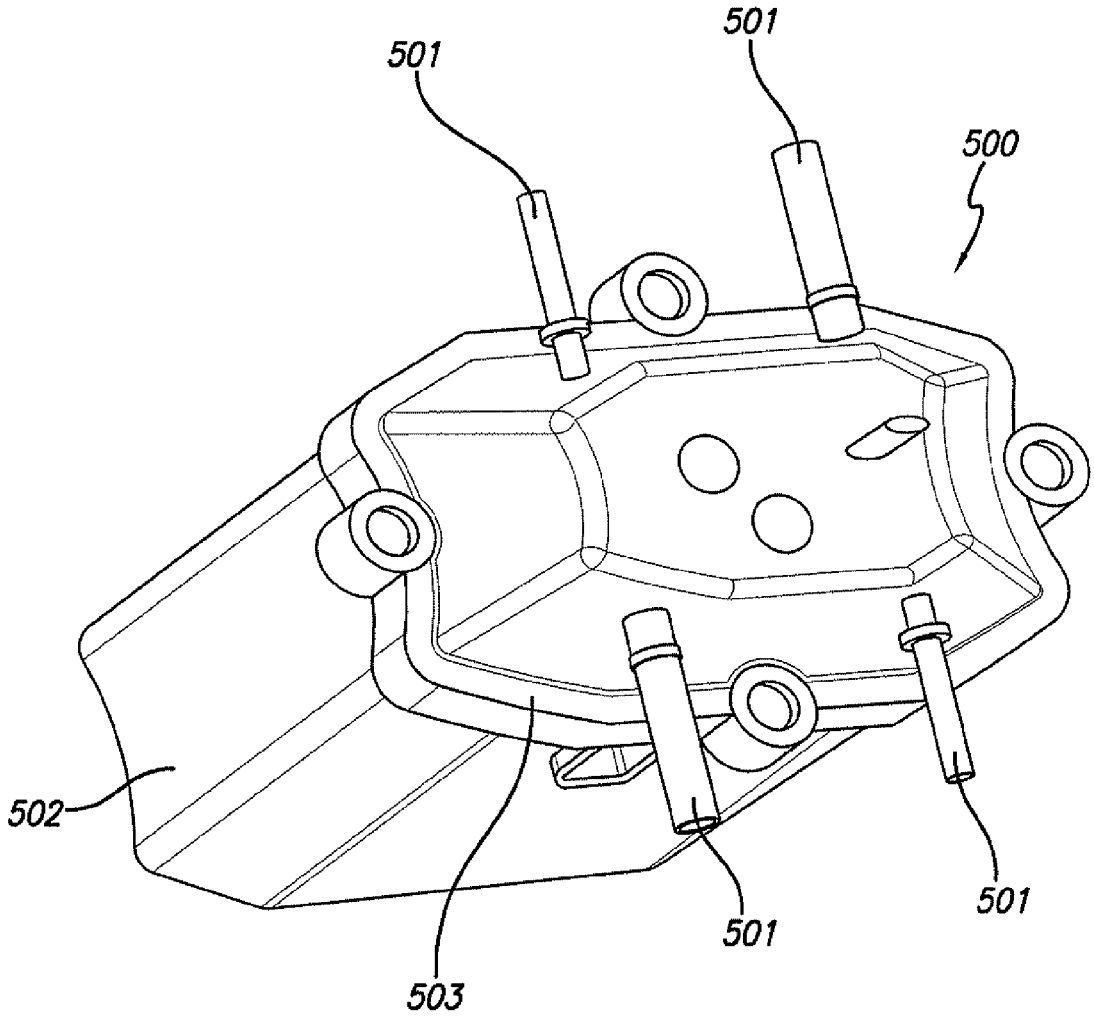
FIG. 5 is a depiction of a battery housing in accordance with the present invention.

The pair of batteries used in the above described embodiments of the invention can be housed in a battery housing that is adapted for the serial connection of a plurality of battery housings to permit the synchronized operation of a plurality of LEDs provided in individually powered lighting strings. The battery housing of the present invention can also be connected to an LED light module to permit the illumination of objects adjacent to the lighting system being powered by the battery housing to which the LED lighting module is connected. A battery housing in accordance with the present invention is depicted in FIG. 5. As depicted therein, a battery housing in accordance with the present invention comprises a housing 500 adapted to be weather-resistant and contain a pair of "D" size batteries and having a cover portion 503 and a body portion 502. The batteries housed within housing 500 are electrically connected via battery contacts within housing 500 to external contacts 501 located in cover portion 503.

Figure 6:
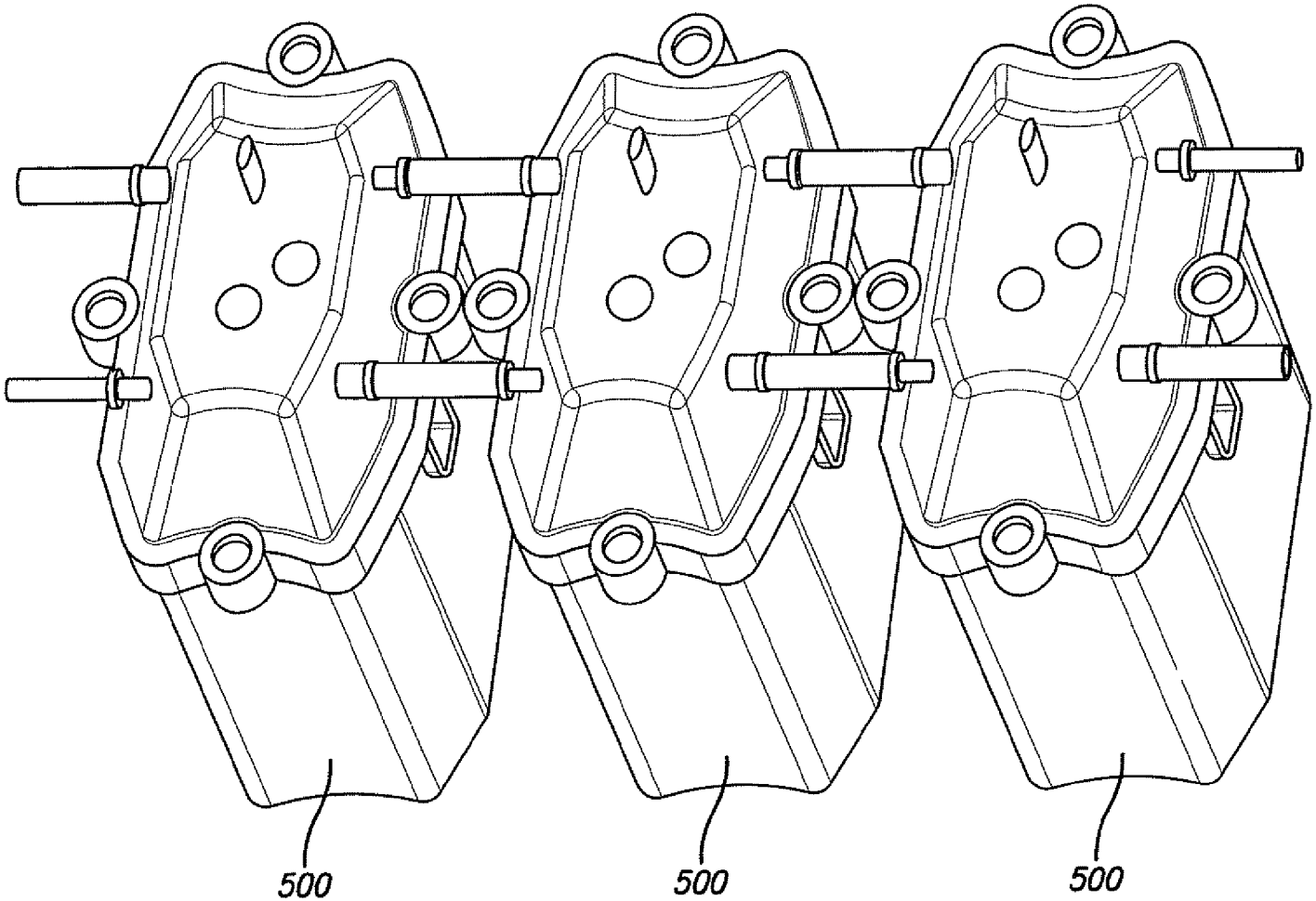
FIG. 6 is a depiction of three battery housings in accordance with the present invention connected in series.

The external contacts 503 are configured to permit the electrical connection of a plurality of battery housings 500. This configuration is depicted in FIG. 6. As shown therein, three battery housings 500 are connected in series to provide power to drive additional lighting strings comprising LEDs.

Figure 7:
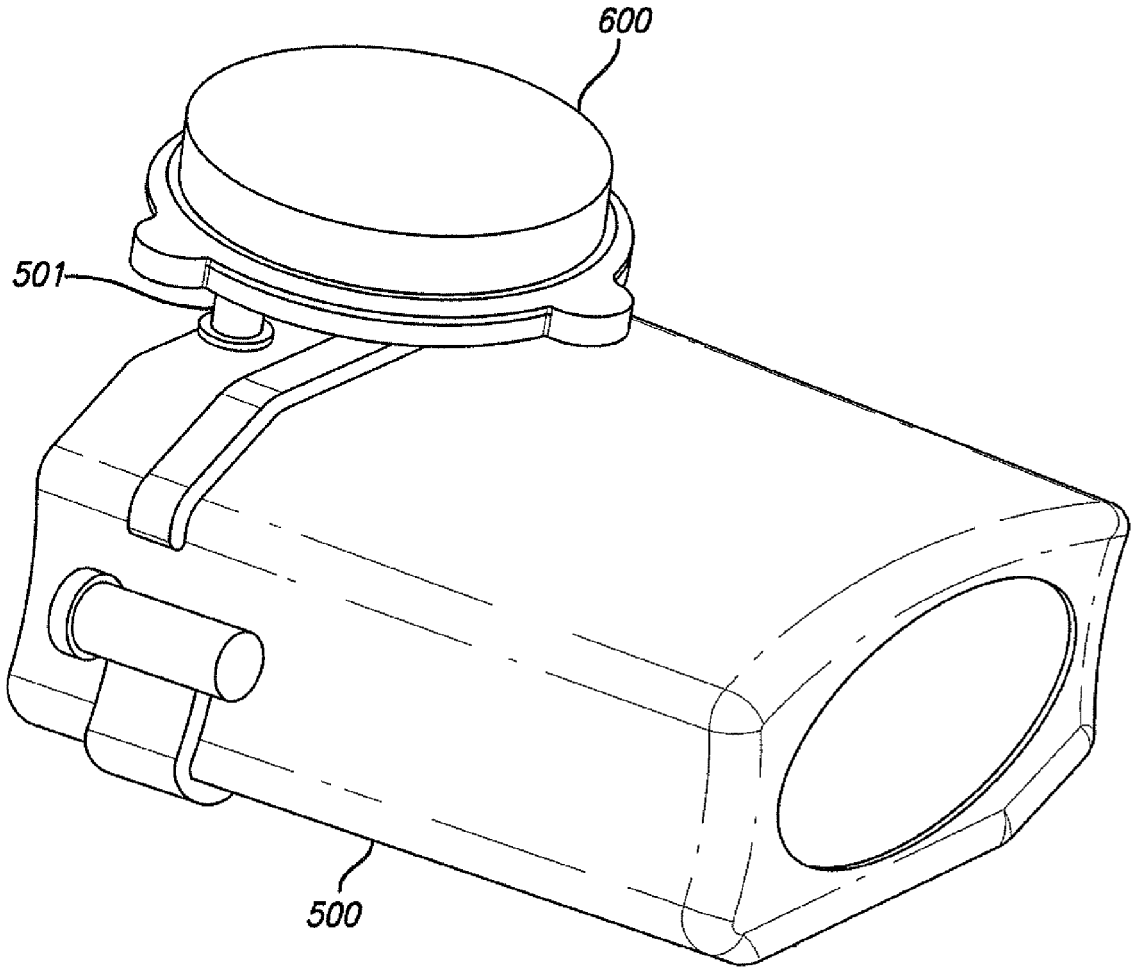
FIG. 7 is a depiction of a battery housing in accordance with the present invention with an LED lighting module attached.

The battery housing 500 of the present invention can also be used to illuminate objects adjacent to the battery housing 500 by connecting the battery housing 500 to an LED module. This configuration is depicted in FIG. 7. As depicted therein, an LED module 600 can be affixed to battery housing 500 via external contacts 501.

It should be noted that the embodiments described above are presented as several possible approaches that may be used to embody the invention. It should be understood that the details presented above do not limit the scope of the invention in any way; rather, the appended claims, construed broadly, completely define the scope of the invention.

I claim:

1. A lighting control circuit comprising:

a boosting circuit, said boosting circuit comprising a first integrated circuit and two 1.5 volt batteries; and an output circuit connected to said boosting circuit, said output circuit comprising a second integrated circuit for controlling an LED lighting load, wherein when said batteries produce an input voltage of 3.0 volts, said first integrated circuit converts said input voltage to an operational voltage 5.0 volts and transmits said operational voltage to said second integrated circuit wherein said operational voltage is selectively transmitted to said LED lighting load.

2. The control circuit according to claim 1 wherein said batteries are housed in a weather-resistant housing comprising a cover portion and external contacts, and wherein the external contacts are adapted to permit the connection of a plurality of said weather-resistant housings in series thereby increasing the electrical power available to illuminate at least one LED lighting load.

3. The control circuit according to claim 2 wherein the weather resistant housing is further adapted to attach to an LED lighting module via the external contacts and adjacent to the housing to permit the illumination of objects in the vicinity of the weather-resistant housing.

4. A lighting control circuit comprising:

a weather-resistant housing in which the batteries are disposed, the housing including external electrical contacts configured to connect the housing to one or more additional weather-resistant housings;

a boosting circuit configured to receive an input voltage of about 3.0 volts from batteries and to convert the input voltage to an operational voltage of about 5.0 volts;

a light string including a plurality of LEDs; and an output circuit connected to the boosting circuit to receive the operational voltage and configured to selectively transmit the operational voltage to the light string.

5. The control circuit of claim 4, further comprising an LED lighting module affixed to the housing and receiving power via the external electrical contacts.

6. A lighting control circuit comprising:

a boosting circuit configured to receive an input voltage from the batteries and to convert the input voltage to a higher operational voltage;

a light string including a plurality of LEDs;

an output circuit connected to the boosting circuit to receive the operational voltage and configured to selectively transmit the operational voltage to the light string; and a timing circuit connected to the output circuit, the timing circuit being configured to initiate operation at a predetermined time and terminate operation after a predetermined interval.

7. A lighting control circuit comprising:

a boosting circuit configured to receive an input voltage from the batteries and to convert the input voltage to a higher operational voltage;

a light string including a plurality of LEDs;

an output circuit connected to the boosting circuit to receive the operational voltage and configured to selectively transmit the operational voltage to the light string; and a timing circuit connected to the output circuit, the timing circuit being configured to operationally cycle power to the light string according to predetermined intervals.

8. A lighting system comprising:

first and second lighting circuits, each comprising:

a weather-resistant housing enclosing batteries, the housing including external electrical contacts;

a boosting circuit configured to receive an input voltage from the batteries and to convert the input voltage to a higher operational voltage;

a light string including a plurality of LEDs; and an output circuit connected to the boosting circuit to receive the operational voltage and configured to selectively transmit the operational voltage to the light string, wherein each housing is connected to the other housing via the external electrical contacts.

9. The lighting system of claim 8, wherein the first lighting circuit is configured to be operatively synchronized with the second lighting circuit.

10. A lighting system comprising:

first, second, and third lighting circuits, each comprising:

a weather-resistant housing enclosing batteries, the housing including external electrical contacts;

a boosting circuit configured to receive an input voltage from the batteries and to convert the input voltage to a higher operational voltage;

a light string including a plurality of LEDs; and an output circuit connected to the boosting circuit to receive the operational voltage and configured to selectively transmit the operational voltage to the light string, wherein each housing is connected to at least one of the other housings via the external electrical contacts.

11. The lighting system of claim 10, wherein the first lighting circuit is configured to be operatively synchronized with one of the other lighting circuits.

* * * * *